US006607079B2

(12) United States Patent
Laux

(10) Patent No.: US 6,607,079 B2
(45) Date of Patent: Aug. 19, 2003

(54) SYSTEM AND METHOD FOR CONTROLLING PARTICLE FLOW DISTRIBUTION BETWEEN THE OUTLETS OF A CLASSIFIER

(75) Inventor: Stefan Laux, Bethlehem, PA (US)

(73) Assignee: Foster Wheeler Energy Corporation, Clinton, NJ (US)

( * ) Notice: Subject to any disclaimer, the term of this patent is extended or adjusted under 35 U.S.C. 154(b) by 35 days.

(21) Appl. No.: 09/930,163

(22) Filed: Aug. 16, 2001

(65) Prior Publication Data

US 2003/0034278 A1 Feb. 20, 2003

(51) Int. Cl.[7] ..... B07B 7/04; B04B 5/12

(52) U.S. Cl. ..... 209/143; 209/139.1; 209/714; 209/721

(58) Field of Search ..... 209/133, 138, 209/139.1, 142, 143, 710, 713, 714, 721

(56) References Cited

U.S. PATENT DOCUMENTS

| | | | | |
|---|---|---|---|---|
| 2,868,462 A | | 1/1959 | Bogot et al. | 241/53 |
| 4,504,018 A | | 3/1985 | Diggins | 241/53 |
| 4,540,129 A | | 9/1985 | Zadiraka | 241/34 |
| 5,884,776 A | * | 3/1999 | Piepho et al. | 209/714 |
| 5,957,300 A | * | 9/1999 | Nardi et al. | 209/143 |
| 6,257,415 B1 | * | 7/2001 | Wark | 209/721 X |

FOREIGN PATENT DOCUMENTS

| | | |
|---|---|---|
| JP | 63-259316 | 10/1988 |

OTHER PUBLICATIONS

"HEP Dynamic Classifier," pamphlet publication of FLS miljø Inc., 8 pages.

International Search Report dated Oct. 17, 2002, issued in corresponding international patent appln. No. PCT/IB 02/02612.

* cited by examiner

*Primary Examiner*—Tuan N. Nguyen
(74) *Attorney, Agent, or Firm*—Fitzpatrick, Cella, Harper & Scinto

(57) ABSTRACT

An apparatus for separating coarse particles from a stream of gas entrained with a mixture of coarse and fine particles includes an outer casing, an inner casing disposed within the outer casing and configured to define a passageway between the outer casing and the inner casing through which the stream of gas and mixture of coarse and fine particles can flow substantially upwardly, a plurality of angled vanes for imparting a rotational flow to the stream of gas and particles as the stream passes from the passageway to within the inner casing in order to separate the coarse particles from the fine particles entrained within the stream of gas, a plurality of outlets for discharging the stream of gas and fine particles from the apparatus, and at least one distribution vane pivotably mounted with respect to the outlets for controlling the distribution of fine particles among the various outlets by affecting the rotational flow of the stream of gas and fine particles.

18 Claims, 3 Drawing Sheets

SYSTEM AND METHOD FOR CONTROLLING PARTICLE FLOW DISTRIBUTION BETWEEN THE OUTLETS OF A CLASSIFIER

BACKGROUND OF THE INVENTION

The present invention relates to improvements in particle classifiers, which separate coarse particles from a stream of gas entrained with a mixture of coarse and fine particles, having several outlet conduits for discharging gas and fine particles. This invention relates particularly to a fuel classifier and a method for separating coarse fuel particles from a mixture of fine and coarse fuel particles entrained in an air stream and returning larger fuel particles to a pulverizer for further size reduction. Meanwhile, the air stream carrying the fine fuel particles can be used for firing a boiler.

Industrial and utility-sized coal boilers may be equipped with two to several dozens of coal burners to deliver fuel to a combustion furnace. The number of burners depends on the size of the boiler and the configuration of the furnace. Commonly-used burner configurations include single wall firing, opposed wall firing, and tangential firing. Coal is typically pulverized in a mill, e.g., a spindle mill or a ball mill, to a fineness that is suitable for combustion in the furnace. Large boilers include several pulverizers, each of which delivers fuel and primary air to a set of burners. One requirement for efficient combustion and low emission levels is that equal or controlled quantities of fuel be delivered to each of the separate burners.

A pulverizer is usually combined with an aerodynamical classifier, which imparts a swirling motion to a coal-air mixture discharged from the mill and centrifugally separates the coal fines from the coarse product. Classifiers operated in a positive air pressure usually have multiple outlet conduits through which coal fines are transported by a flow of primary air to multiple burners in the boiler. The coarse material is returned to the mill and re-ground.

In order to observe stringent environmental regulations and to achieve efficient boiler operation, the flows of coal and air from the classifier to each burner must be precisely controlled. Generally, the air distribution can be balanced quite easily by adjusting the flow impedances of the various coal-air lines. The coal flow, on the other hand, is more difficult to control since it is dependent, in a complicated way, on the conditions within the pulverizer, classifier, and fuel lines, including the burners.

The distribution of the coal flow between the various outlet conduits in a classifier can be improved by increasing the homogeneity of the pulverized coal in the vicinity of the classifier outlets. This can be achieved by improving the pulverizer performance or by optimizing the geometry of the classifying blades. Japanese Patent Publication JP 63259316 A2, for example, discloses a coal distributor wherein a swirling solid-gas flow is transformed by radial vanes into a vertically uprising flow which collides with a horizontal plate so as to achieve a uniform particle concentration. Despite this and other like measures to provide a homogeneous coal distribution, the coal tends to turn stratified in the classifier, resulting in flow variations as large as 20% among the various outlets.

U.S. Pat. No. 4,540,129 discloses a pulverizer wherein each of the multiple lines between the pulverizer and a set of coal burners includes a valve to control the flow rates of coal and primary air. This commonly-used method controls the coal and air streams simultaneously, but does not make it possible to affect the coal flow irrespective of the air flow. Due to the different characteristics of air and coal streams, there are often situations where a coal stream needs to be adjusted independently of the air stream.

It is also known to arrange adjustable guide vanes at the outlets of each coal line in a classifier. The guide vanes either capture the pulverized coal or divert it from the outlet. These vanes, however, also impede the flow of primary air, and thus affect both the air and the coal flow. Therefore, such vanes have only limited potential for balancing an asymmetrical coal distribution within a classifier.

SUMMARY OF THE INVENTION

An object of the present invention is to provide an apparatus and method for achieving efficient and environmentally advantageous operation of a pulverized fuel fired boiler.

More particularly, an object of the present invention is to provide a particle classifier and a method for utilizing the particle classifier in order to balance the distribution of pulverized fuel among multiple outlet conduits of the particle classifier.

A further object of the present invention is to provide a new particle classifier and a method for utilizing the particle classifier in order to balance the distribution of pulverized fuel among the multiple outlet conduits of the particle classifier while minimizing the effect on the primary air flow distribution.

Another object of the present invention is to provide a new particle classifier and a method for utilizing the particle classifier in order to maintain a balanced distribution of pulverized coal among the multiple outlet conduits of the particle classifier in various process conditions.

In one aspect, the present invention relates to a classifier for separating coarse particles from a stream of gas and a mixture of coarse and fine particles. The classifier includes a generally cylindrical outer casing including a vertically-oriented side wall and an upper head, a generally conical inner casing provided within the outer casing and configured so as to provide an annular passageway between the inner casing and the side wall of the outer casing through which the stream of gas and particles can flow upwardly, a plurality of angled circumferentially-spaced vanes supported by the upper head of the outer casing for imparting rotational motion to the stream of gas and particles so as to separate coarse particles from the mixture of coarse and fine particles, and an outlet chamber at an upper portion of the inner casing. The outlet chamber includes (i) a top plate with a plurality of outlet openings for discharging streams of gas and fine particles from the classifier, and (ii) at least one pivotable distribution vane for controlling the distribution of the fine particles between each of the outlet openings by affecting the rotational movement of the stream of gas and particles.

In another aspect, the present invention relates to a method for separating coarse particles from a stream of gas and a mixture of coarse and fine particles in a classifier. The method includes (a) passing the stream of gas and particles upward through an annular passageway between a side wall of a generally cylindrical outer casing and a generally conical inner casing, (b) imparting rotational motion to the stream of gas and particles so as to separate coarse particles from the mixture of coarse and fine particles by passing the stream of gas and particles through a plurality of angled circumferentially-spaced vanes attached between an upper edge of the inner casing and an upper head of the outer casing, and (c) discharging streams of gas and fine particles through a plurality of outlet openings in a top plate of an outlet chamber at an upper portion of the inner casing. In step (c) the rotational movement of the stream of gas and particles in the outlet chamber is affected by adjusting the pivot angle of at least one pivotable distribution vane arranged in the outlet chamber so as to control the distribution of fine particles between each of the outlet openings.

In still another aspect, the present invention relates to an apparatus for separating coarse particles from a stream of gas entrained with a mixture of coarse and fine particles. The apparatus includes an outer casing, an inner casing disposed within the outer casing and configured to define a passageway between the outer casing and the inner casing through which the stream of gas and mixture of coarse and fine particles can flow substantially upwardly, a plurality of angled vanes for imparting a rotational flow to the stream of gas and particles as the stream passes from the passageway to within the inner casing in order to separate the coarse particles from the fine particles entrained within the stream of gas, a plurality of outlets for discharging the stream of gas and fine particles from the apparatus, and at least one distribution vane pivotably mounted with respect to the outlets for controlling the distribution of fine particles among the various outlets by affecting the rotational flow of the stream of gas and fine particles.

In a further aspect, the present invention relates to a method of using a classifier to separate coarse particles from a stream of gas entrained with a mixture of coarse and fine particles. The method includes (a) imparting rotational movement to the stream of gas and particles by passing the stream through a plurality of angled vanes, (b) separating, by centrifugal and gravitational force, the coarse particles from the fine particles entrained within the stream of gas, (c) discharging the stream of gas entrained with the fine particles from a plurality of outlets in the classifier, and (d) controlling, by adjusting at least one distribution vane in a way that affects the rotational movement of the stream of gas and fine particles within the classifier, the distribution of the fine particles to the outlets.

Coal mill classifiers typically include one or more sets of vanes, which induce a swirling or rotational motion in the coal-air stream and bring about centrifugal separation of coarse coal particles from the stream. The downstream portion of the classifier comprises an outlet chamber, or space, for distributing the fine coal between the various outlet conduits of the classifier. Usually, the outlet space is located symmetrically at the top portion of the classifier and is provided with a coal inlet conduit at its vertical symmetry axis. The outlet space is restricted by a cylindrical or conical side wall and an annular top plate including a plurality of coal outlets. The side wall may be a solid wall or it may comprise static or rotatable vanes. The outlet space generally does not include means for further enhancing the swirling of the coal-air stream.

The distribution vanes are arranged in the outlet space to cause balanced coal distribution to the various outlets. They can be used for partially disrupting the swirling pattern of the air-coal mixture in the outlet space and thereby producing additional mixing and more homogenous coal distribution. More particularly, the distribution vanes can be used for balancing the coal flow between the various outlets by, as required, decreasing or increasing the coal flow to one or more of the outlets. In order not to adversely affect the air flow, the distribution vanes are generally arranged in positions that are spaced apart from the outlet openings.

Typically, the annular top plate of the outlet space comprises circular inner and outer zones and a circular zone between the inner and outer zones including symmetrically distributed coal outlets, hereinafter referred to as the circular intermediate zone. It is also possible that the outlets abut the central coal inlet conduit and/or the outer edge of the top plate, in which case there would be no inner and/or outer zone. The areas in the intermediate zone between the coal outlets are hereinafter referred to as the "intermediate free areas."

The distribution vanes are, according to a preferred embodiment of the present invention, arranged below the intermediate free areas. There may be only one distribution vane located below a selected free area, or there may be multiple vanes arranged below the various free areas. According to a preferred embodiment of the present invention, there is a distribution vane located below the free areas between each of the coal outlets.

According to another preferred embodiment of the present invention, the distribution vanes are arranged below the outer zone. In this embodiment, preferably one or more distribution vanes are arranged radially outside the intermediate free areas, but they can also be arranged radially outside the areas of the coal outlets.

According to a third preferred embodiment of the present invention, the distribution vanes are arranged below the inner zone. In this embodiment, preferably one or more distribution vanes are arranged radially inside the intermediate free areas, but they can also be arranged radially inside the areas of the coal outlets.

In order to balance coal flow distribution among the various outlets, the orientations of the distribution vanes are adjustable, preferably individually adjustable. In some cases an initial adjustment may be sufficient for eliminating flow maldistributions, but preferably the distribution vanes are equipped with means, such as a crank operated by a hydraulic or pneumatic piston, for adjusting the vane orientations externally, whenever needed. There may be a controller and/or user interface linked between the means for adjusting the vane orientations and devices measuring coal flow in different outlet conduits of the classifier.

According to a preferred embodiment of the present invention, each distribution vane is pivotably connected to a vertical shaft attached to the top plate of the outlet chamber. In some geometries it may also be possible to attach the shafts to the side wall or to a bottom plate of the outlet chamber. The shafts are preferably connected to the leading edges or to the central parts of the vanes.

The distribution vanes are preferably arranged in the upper part of the outlet space. The lengths and heights of the vanes are typically between about 50% and about 150% of the diameter of the outlet conduits. According to a preferred embodiment of the present invention, the vanes can be pivoted from the original orientation along the swirling flow direction to a maximal pivot angle transverse to the flow direction. Preferably, in the maximal tilt orientation the vanes cover between about 30% and about 70% of the corresponding vertical cross section of the upper part of the outlet space. According to another preferred embodiment of the present invention, the vanes can be pivoted in both directions, e.g., from about +45 degrees to about −45 degrees from their original orientation.

When all the distribution vanes are oriented along the local swirl, they have a relatively insignificant effect on the swirling flow. When one or more of the vanes partially or completely traverse the swirl, however, the vanes redirect the coal flow and enable control of the coal distribution. The air flow is much less affected by the distribution vanes than the coal flow. Therefore, it is possible to balance the coal flow through adjustment of the distribution vanes while minimizing the effect on the primary air flow. Nor do the distribution vanes of the present invention cause any significant pressure loss.

The present invention thus improves the combustion process in the furnace by decreasing the amount of unburned carbon in the ash. Also, the emission levels, especially the NOx-emissions, are reduced by the improved stoichiometric ratio of fuel and air provided to the burners. Controlling the air and fuel balance at the burners also results in improved boiler oxygen and steam temperature profiles.

The present invention can be applied to all types of vertical spindle mills and other mill types that utilize the aerodynamical classifiers commonly found on vertical spindle mills. It can be used with static as well as rotating classifiers equipped with several coal outlets and, thus, having a need to balance the coal flow between the various outlets.

A better understanding of these and other objects, features, and advantages of the present invention may be had by reference to the drawings and to the accompanying description, in which preferred embodiments of the invention are illustrated and described.

BRIEF DESCRIPTION OF THE DRAWINGS

Throughout the figures, like reference numerals have been used for like or corresponding parts.

DETAILED DESCRIPTION OF THE PREFERRED EMBODIMENTS

Figure 1:
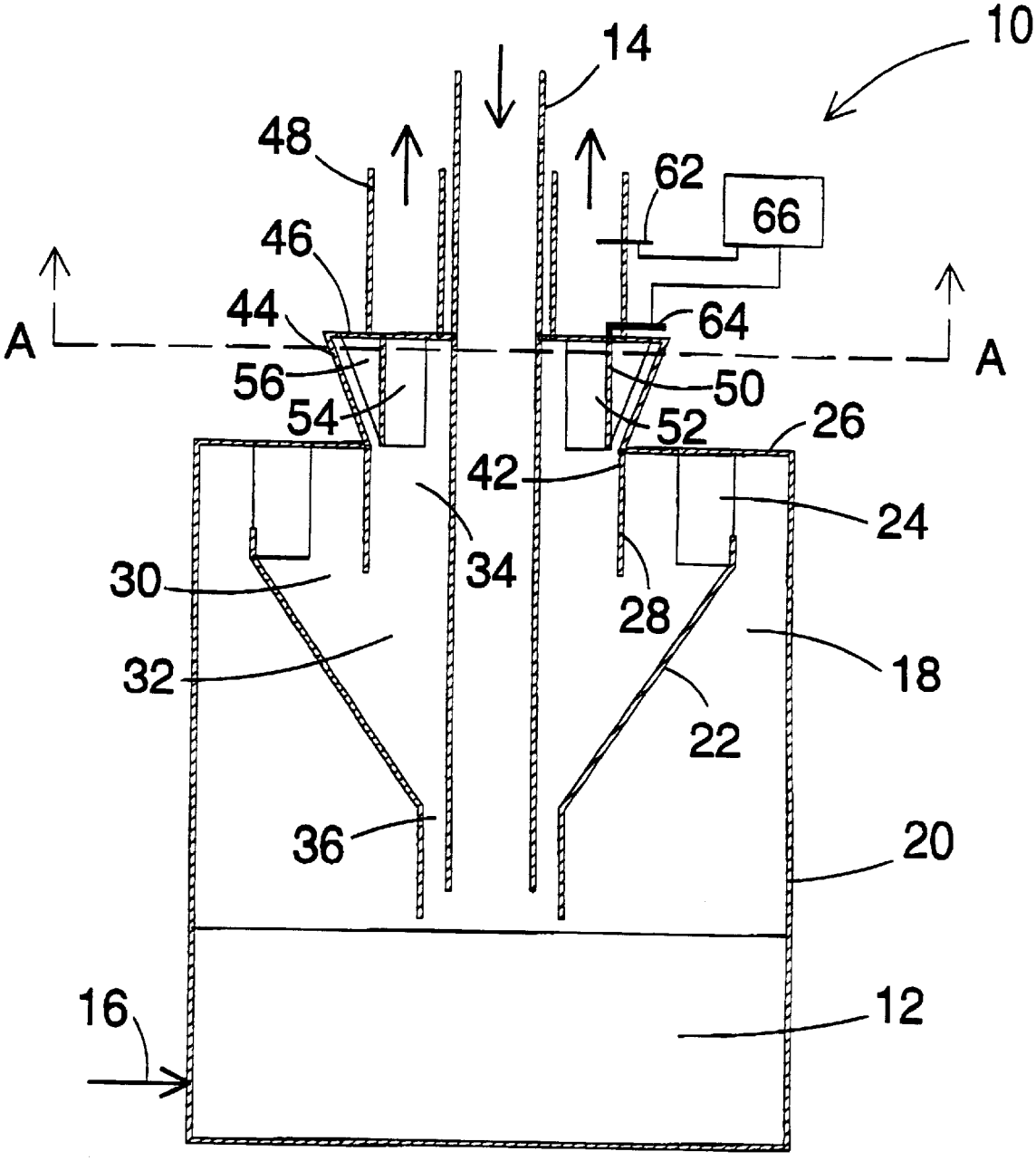
FIG. 1 is a schematic vertical cross-sectional view of a classifier equipped with distribution vanes according to the present invention.

FIG. 1 schematically depicts a classifier 10 mounted on top of a spindle mill pulverizer 12. The coarse coal feed passes to the pulverizer 12 in a conventional way downwardly through a central conduit 14 to a pulverizing table (not shown) where one or more rolls (not shown) are pressed against the table to pulverize the raw material. An air stream is supplied to the lower portion of the pulverizer 12 through a conduit 16 for carrying the crushed coal particles upwardly into the classifier through an annular passageway 18 formed by an outer cylindrical side wall 20 and an inner conical wall 22. The upper end of the conical wall 22 is attached to the lower side of multiple circumferentially-spaced angled vanes 24 whose upper sides are attached to an upper head 26.

From the annular passageway 18, the coal particles are entrained by the air stream generally radially inwardly through the angled vanes 24, which impart a rotational, or swirling, motion to the airborne particles. A central cylindrical wall 28 is arranged radially inside the vanes 24. The central cylindrical wall 28 extends from the upper head 26 to below the level of the lower edges of the vanes 24.

From the vanes 24 the coal particles swirl through a passageway 30 downward to a separation space 32 below the lower end of the wall 28. From the separation space 32 the smaller coal particles are entrained by the air stream generally radially inwardly and upwardly towards an annular outlet space or chamber 34. The remaining larger and heavier particles are thrown by centrifugal force and gravity action outwardly to the proximity of the inner surface of the conical casing 22, from where they pass downwardly through an opening 36 to the pulverizer 12.

The outlet space 34 is bounded in part by a side wall 42, which consists of the cylindrical wall 28 and a conical upper portion 44, and a top plate 46, which forms an outlet flange. Multiple conduits 48 for carrying the coal-air mixture from the classifier 10 to a set of burners (not shown) are connected to the top plate 46. The number of outlet conduits is typically four, but it may vary from two to eight or more.

Distribution vanes 52 are connected to vertical shafts 50 attached to the top plate 46. Each of the distribution vanes 52 is pivotably adjustable about its shaft or axis so as to affect the swirling coal-air mixture within the outlet space 34. In one of the outlet conduits 48 a device 62 for measuring the coal flow in the outlet conduit is shown schematically. Advantageously, measuring devices 62 can be provided in each outlet conduit 48. To the vertical shafts 50 are connected means 64, such as a crank operated by a hydraulic or pneumatic piston, for adjusting the vane orientations. There may be a controller 66 and/or a user interface (not shown) linked between the measuring devices 62 and the means 64 for adjusting the distribution vanes 52 on the basis of online coal flow measurements. The pivot angles of the distribution vanes 52 can thus be adjusted on the basis of the measured coal flow in each outlet conduit 48 so as to balance the coal flow through the various outlet conduits 48.

The shafts 50 of the vanes 52 are connected, according to the embodiment shown in FIG. 1, between a larger trailing portion 54 and a smaller leading portion 56 of the vanes 52. The vanes 52 are shaped in such a way that, when tilted across the rotational flow, as in FIG. 1, they cover most of the vertical cross section of the upper portion of the outlet space 34. Due to the larger trailing portion 54, the vanes 52 have a well-defined equilibrium orientation along the coal-air swirl in the outlet space 34.

The embodiment shown in FIG. 1 makes it possible to affect the coal flow very effectively. If less effective control is acceptable, the vanes 52 can have a simple rectangular shape and the shaft may be connected to the leading edge of the vanes 52. In that case the area covered by the vanes 52 will not be as is shown in FIG. 1.

Figure 2:
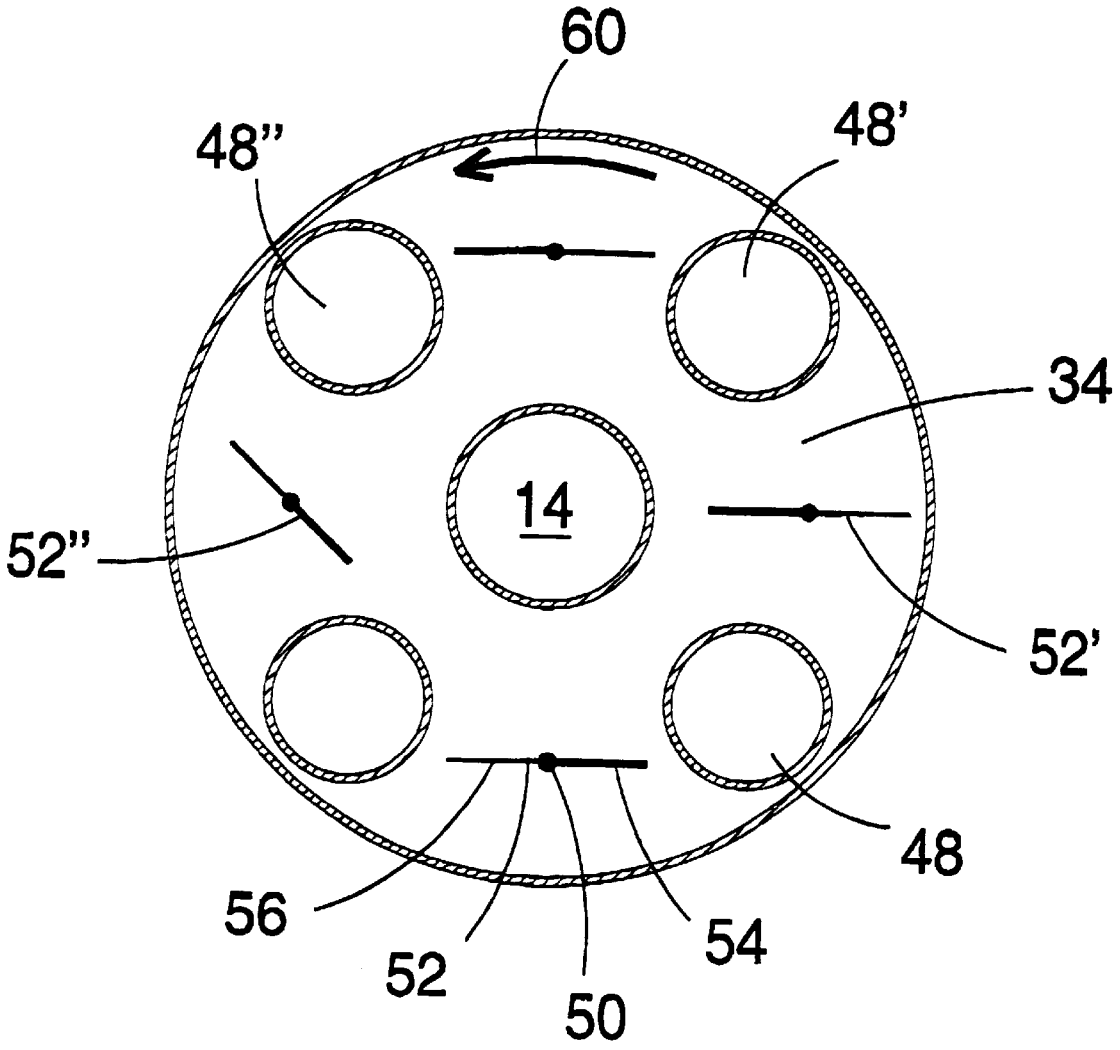
FIG. 2 is a schematic horizontal cross-sectional view of a classifier according to a first embodiment of the present invention.

FIG. 2 depicts a horizontal cross-sectional view of the classifier 10 taken along section line A–A in FIG. 1. Shown in FIG. 2 are the outlet space 34, the conduit 14 for introducing raw material to the spindle mill pulverizer 12, and four outlets 48 for discharging a mixture of air and fine coal particles from the classifier 10. The distribution vanes 52 are arranged in the outlet space 34 between the outlets 48. The distribution vanes 52 are pivotably connected to the shafts 50. In the original orientation the trailing portion 54 of vane 52 is oriented along the direction traveled by the swirl 60 of the mixture of air and fine coal. In order to provide a large coverage of the vertical cross section of the upper part of the outlet space 34, the vanes 52 also comprise a smaller leading portion 56, shown by a thinner line in the figure. FIG. 2 shows a case where the trailing part of one of the vanes, i.e., vane 52', is oriented ninety degrees inward in order to decrease the coal flow to the outlet 48'. Another vane 52" is oriented forty-five degrees inward to further adjust the coal distribution to the various outlets.

Figure 3:
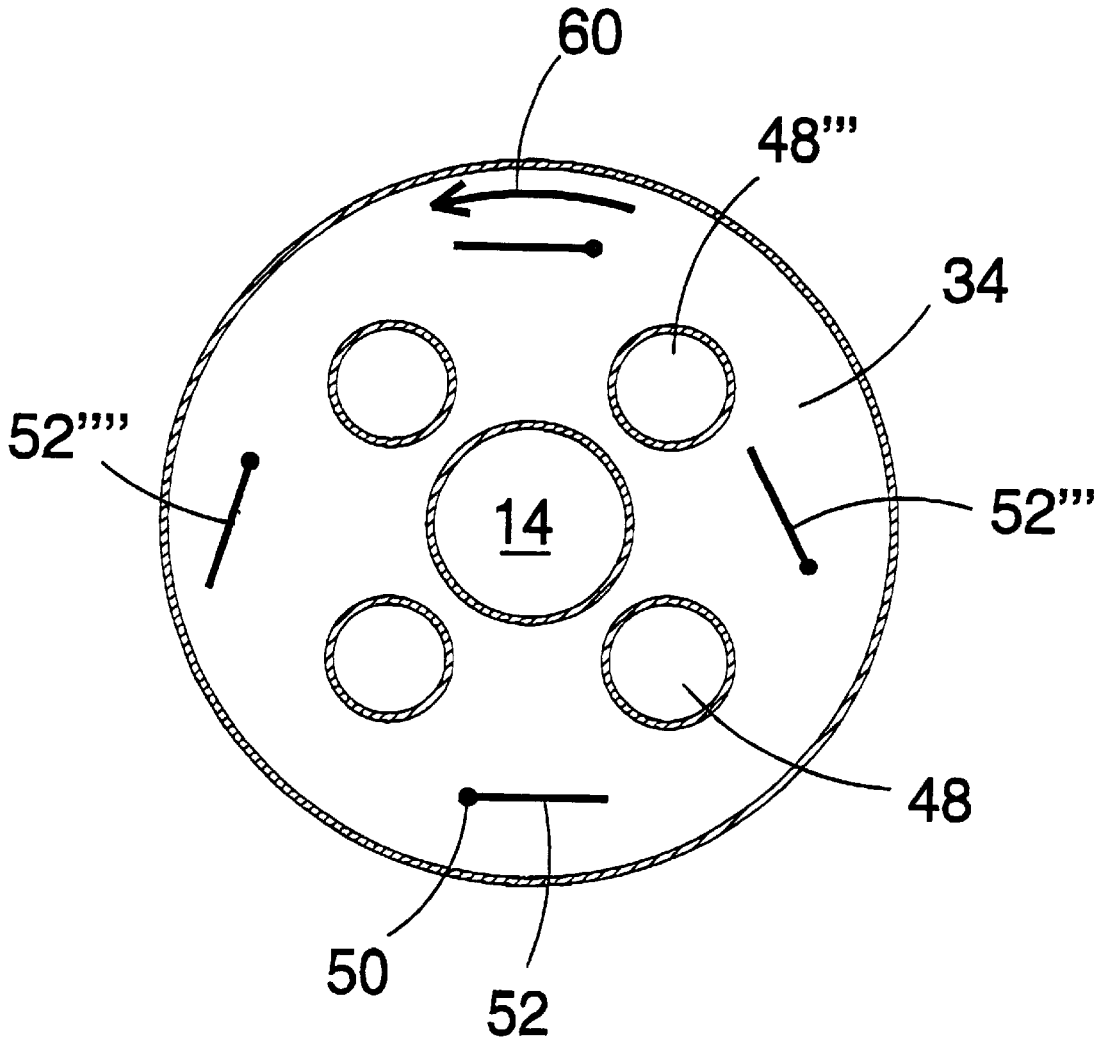
FIG. 3 is a schematic horizontal cross-sectional view of a classifier according to a second embodiment of the present invention.

FIG. 3 shows a horizontal cross-sectional view of the classifier 10, similar to the view shown in FIG. 2, according to another embodiment of the present invention. In this embodiment, the distribution vanes 52 are arranged in an outer circumferential zone of the outlet space 34. The vanes are pivotably connected to shafts 50 at their leading edge. In FIG. 3, vane 52''' is oriented about thirty degrees inward to increase the coal flow to the outlet 48''', and vane 52'''' is oriented about fifteen degrees outward to further adjust the coal distribution.

Examples of applying the present invention to a static classifier have been described above. Even in a static classifier, the shape and position of the outlet space 34 as well as the shapes of the cone 22 and the cylinder 28, for example, may be different from those shown in FIG. 1. For instance, in some static classifiers the top plate 46 can be located on the same level as the head 26, with the outlet space being arranged within the cylindrical wall 28. The axes of the vanes 52 are vertical in the embodiment shown in FIG. 1, and, thus, pivoting of the vanes 52 affects mainly the horizontal flow of the coal-air mixture.

In another embodiment of the present invention, the axes of the vanes are inclined while being attached to the conical side wall 44 of the outlet space 34. In this case, the effect of the vanes is more complicated, but still the vanes can be used for balancing the coal distribution between the various outlet conduits 48 by redirecting the coal flow. The main criteria for the positioning of the distribution vanes 52 is that while being oriented along the swirling flow in the outlet space 34, the vanes allow for substantially free flow of air and coal to each of the outlet conduits 48.

The present invention can also be used with a dynamic classifier, wherein a set of rotating vanes is arranged radially inside the fixed swirl-inducing vanes to enhance the separation of coarse particles from the fine particles. As for the shapes and positions of the vanes, cones, and cylinders in a dynamic classifier, there are several alternatives. The outlet space, where air and fine coal are distributed between the various outlets, can be located immediately inside the rotating vanes, or a separate conical or cylindrical outlet space may be provided.

Tests were performed using four distribution vanes arranged below the intermediate free areas between four coal outlets, such as shown in FIG. 2. Pivoting the trailing portion of the vane 52' from its original direction along the swirling flow towards the axis of the classifier mainly decreased the flow to outlet 48'. The decrease was almost directly proportional to the pivot angle and reached a maximum of about 15% when the vane completely traversed the original flow direction. Pivoting vane 52' also decreased to some extent the flow to outlet 48" and somewhat increased the flow to outlet 48.

When multiple vanes were tilted, the effect on the outlet flows was rather complex. However, in all cases a transverse vane very distinctly decreased the flow to the following outlet. The effect of smaller tilting angles of multiple tilted vanes varied from case to case. It appeared, however, that at least by an iterative process it is possible to reduce any flow maldistributions smaller than 10% to a residual error of less than 2%.

In the above-described tests, the distribution vanes were located in the circular intermediate zone and the main effect of tilting a vane was a decrease in the coal flow to the following outlet. If instead the distribution vanes are positioned in the inner or outer zone, they can also be used for directing more coal to the next outlet. This can be achieved by pivoting a vane in the outer zone inward or a vane in the inner zone outward.

Except as otherwise disclosed herein, the various components shown in outline or block form in the figures are individually well known and their internal construction and operation are not critical either to the making or using of this invention or to a description of the best mode of practicing the invention.

While the present invention has been described with respect to what are currently considered to be the preferred embodiments, it is to be understood that the invention is not limited to the disclosed embodiments. Rather, the invention is intended to cover various modifications and equivalent arrangements included within the spirit and scope of the accompanying claims. The scope of those claims should be accorded the broadest interpretation so as to encompass all such modifications and equivalent structures and functions.

Industrial Applicability

The present invention can be utilized, for example, in the separation of coarse fuel particles from a mixture of fine and coarse fuel particles entrained in an air stream. The air stream carrying the fine fuel particles can be used for firing a boiler or the like, while the coarse fuel particles can be returned to a pulverizer for further size reduction. The present invention, in particular, relates to controlling the distribution of fine fuel particles among the various outlets of a classifier, thereby improving the overall combustion process.

I claim:

1. A classifier for separating coarse particles from a stream of gas and a mixture of coarse and fine particles, the classifier comprising:

a generally cylindrical outer casing including a vertically-oriented side wall and an upper head;

a generally conical inner casing provided within the outer casing and configured so as to provide an annular passageway between the inner casing and the side wall of the outer casing through which the stream of gas and particles can flow upwardly;

a plurality of angled circumferentially-spaced vanes supported by the upper head of the outer casing for imparting rotational motion to the stream of gas and particles so as to separate coarse particles from the mixture of coarse and fine particles; and an outlet chamber at an upper portion of the inner casing, the outlet chamber including (i) a top plate with a plurality of outlet openings for discharging streams of gas and fine particles from the classifier, and (ii) at least one pivotable distribution vane for controlling the distribution of the fine particles between each of the outlet openings by affecting the rotational movement of the stream of gas and particles, wherein when the at least one distribution vane is oriented along the direction of rotational movement of the stream of gas and particles in the outlet chamber, the classifier provides a substantially uninhibited flow of gas and particles to the outlet openings.

2. A classifier according to claim 1, wherein when the at least one distribution vane is oriented at least partially transverse to the direction of rotational movement of the stream of gas and particles in the outlet chamber, the flow of particles to at least one of the outlet openings is decreased.

3. A classifier according to claim 1, wherein the outlet chamber includes a plurality of pivotable distribution vanes and each distribution vane is pivotable independently of the other distribution vanes.

4. A classifier according to claim 1, wherein the at least one distribution vane is spaced apart from the outlet openings.

5. A classifier according to claim 1, wherein the at least one distribution vane is arranged below an outer zone of the top plate or below an intermediate free area between adjacent outlet openings.

6. A classifier according to claim 1, wherein the at least one distribution vane is pivotably supported on a vertical pivot shaft attached to the top plate.

7. A classifier according to claim 1, wherein the outlet chamber is horizontally restricted by one of (i) a solid wall and (ii) a wall equipped with vanes.

8. A classifier according to claim 1, wherein the height and width of the at least one distribution vane is from about 50% to about 150% of the diameter of one of the outlet openings.

9. A classifier according to claim 1, wherein the outlet chamber includes a plurality of pivotable distribution vanes and the distribution vanes cover at most between about 30% and about 70% of the vertical cross section of an upper portion of the outlet chamber.

10. A method for separating coarse particles from a stream of gas and a mixture of coarse and fine particles in a classifier, the method comprising the steps of:

(a) passing the stream of gas and particles upward through an annular passageway between a side wall of a generally cylindrical outer casing and a generally conical inner casing;

(b) imparting rotational motion to the stream of gas and particles so as to separate coarse particles from the mixture of coarse and fine particles by passing the stream of gas and particles through a plurality of angled circumferentially-spaced vanes attached between an upper edge of the inner casing and an upper head of the outer casing; and (c) discharging streams of gas and fine particles through a plurality of outlet openings in a top plate of an outlet chamber at an upper portion of the inner casing, wherein in step (c) the rotational movement of the stream of gas and particles in the outlet chamber is affected by adjusting the pivot angle of at least one pivotable distribution vane arranged in the outlet chamber so as to control the distribution of fine particles between each of the outlet openings, and wherein when the at least one distribution vane is oriented along the direction of rotational movement of the stream of gas and particles in the outlet chamber, there is a substantially uninhibited flow of gas and particles to the outlet openings.

11. A method according to claim 10, wherein when the at least one distribution vane is oriented at least partially transverse to the direction of rotational movement of the stream of gas and particles in the outlet chamber, the flow of particles to at least one of the outlet openings is decreased.

12. A method according to claim 10, further comprising a step of:

(d) measuring a particle flow downstream of at least two outlet openings, wherein in step (c) the pivot angle of the at least one distribution vane is adjusted based on the particle flow measurements in step (d).

13. An apparatus for separating coarse particles from a stream of gas entrained with a mixture of coarse and fine particles, the apparatus comprising:

an outer casing;

an inner casing disposed within the outer casing and configured to define a passageway between the outer casing and the inner casing through which the stream of gas and mixture of coarse and fine particles can flow substantially upwardly;

a plurality of angled vanes for imparting a rotational flow to the stream of gas and particles as the stream passes from the passageway to within the inner casing in order to separate the coarse particles from the fine particles entrained within the stream of gas;

a plurality of outlets for discharging the stream of gas and fine particles from the apparatus; and at least one distribution vane pivotably mounted with respect to the outlets for controlling the distribution of fine particles among the various outlets by affecting the rotational flow of the stream of gas and fine particles, wherein when the at least one distribution vane is oriented along the direction of rotational movement of the stream of gas and particles in the outlets, the apparatus provides a substantially uninhibited flow of gas and particles to the outlets.

14. The apparatus of claim 13, wherein the apparatus comprises at least two pivotable distribution vanes.

15. The apparatus of claim 14, wherein the distribution vanes are independently pivotable.

16. The apparatus of claim 14, wherein the number of distribution vanes equals the number of outlets.

17. The apparatus of claim 13, wherein the at least one distribution vane is pivotable between a first position, in which the distribution vane is oriented substantially along the direction of the rotational flow of the stream of gas and particles, and a second position, in which the distribution vane is oriented at least partially transverse to the direction of the rotational flow of the stream of gas and particles.

18. A method of using a classifier to separate coarse particles from a stream of gas entrained with a mixture of coarse and fine particles, the method comprising the steps of:

(a) imparting rotational movement to the stream of gas and particles by passing the stream through a plurality of angled vanes;

(b) separating, by centrifugal and gravitational force, the coarse particles from the fine particles entrained within the stream of gas;

(c) discharging the stream of gas entrained with the fine particles from a plurality of outlets in the classifier; and (d) controlling, by adjusting at least one distribution vane in a way that affects the rotational movement of the stream of gas and fine particles within the classifier, the distribution of the fine particles to the outlets, wherein when the at least one distribution vane is oriented along the direction of rotational movement of the stream of gas and particles in the outlets, there is a substantially uninhibited flow of gas and particles to the outlets.

* * * * *